US008123570B2

(12) United States Patent
Chang

(10) Patent No.: US 8,123,570 B2
(45) Date of Patent: Feb. 28, 2012

(54) DISPLAYPORT STRUCTURE

(76) Inventor: Nai-Chien Chang, Sanchong (TW)

( * ) Notice: Subject to any disclaimer, the term of this patent is extended or adjusted under 35 U.S.C. 154(b) by 0 days.

(21) Appl. No.: 12/917,049

(22) Filed: Nov. 1, 2010

(65) Prior Publication Data

US 2011/0136393 A1 Jun. 9, 2011

(30) Foreign Application Priority Data

Dec. 4, 2009 (TW) ..... 98222746 U

(51) Int. Cl.
*H01R 24/00* (2011.01)

(52) U.S. Cl. ..... 439/676

(58) Field of Classification Search ..... 439/676, 439/668, 941, 76.1
See application file for complete search history.

(56) References Cited

U.S. PATENT DOCUMENTS

| | | | | |
|---|---|---|---|---|
| 7,927,152 | B2 * | 4/2011 | Pepe et al. | 439/676 |
| 2007/0117468 | A1 * | 5/2007 | Huang et al. | 439/676 |
| 2008/0132123 | A1 * | 6/2008 | Milette et al. | 439/676 |
| 2010/0003862 | A1 * | 1/2010 | Hetzer et al. | 439/676 |
| 2011/0053428 | A1 * | 3/2011 | Pepe et al. | 439/668 |

* cited by examiner

*Primary Examiner* — Jean F Duverne
(74) *Attorney, Agent, or Firm* — Chun-Ming Shih; HDLS IPR Services

(57) ABSTRACT

An improved DisplayPort structure includes a base, a circuit board, a chassis and a casing. The base has a containing space, a retaining wall formed at a front end of the containing space, an opening formed on the retaining wall. The circuit board is installed in the containing space, and an end of the circuit board is passed through the opening and out of the retaining wall, and at least one surface of the circuit board has a plurality of conductive pins, and a transmission line segment is extended from an end of each conductive pin and electrically coupled to a conductive terminal. The casing is mounted onto the exterior of the base and the casing includes a hollow main body, and a port is formed at a front end of the main body and provided for exposing the circuit board.

10 Claims, 6 Drawing Sheets

DISPLAYPORT STRUCTURE

FIELD OF THE INVENTION

The present invention relates to a connector, in particular to a DisplayPort structure capable of transmitting high-resolution digital audio and video signals to a display device.

BACKGROUND OF THE INVENTION

The VESA DisplayPort standard was developed by the PC and digital electric appliance industries as the next generation digital image transmission interface to replace the present existing PC image transmission interfaces such as the low-voltage differential signaling (LVDS), DVI and VGA and provide an internal/external high-bandwidth digital image (including audio and video) transmission function.

In general, a DisplayPort connector includes a base, a plurality of conductive pins, and a metal casing. In a manufacturing process, a thin metal sheet is stamped to produce the conductive pins. After the base made of a plastic material is formed in an injection molding process, the conductive pins are combined with the base, or the conductive pins are placed into a mold and then integrally formed with the base by the injection molding process, such that an end of each conductive pin is fixed onto a tongue plate of the base, and another end of each conductive pin is extended to the exterior of the metal casing after the base is assembled with the metal casing.

Since the base and the conductive pins of the DisplayPort connector are manufactured separately, small flexible pillar-shaped objects will be produced after the conductive pins are formed by the stamping process, and thus it is uneasy to install the DisplayPort connector into a pin slot of the base. If the conductive pins are placed into the mold and integrally formed with the base by the injection molding process, and the conductive pins and the base are not connected closely enough, ends of the conductive pins may be warped slightly, such that after a plug of an external DisplayPort transmission line is inserted, the conductive pins may be crooked or unable to contact with the pins in the plug of the DisplayPort transmission line, and thus resulting in a failure of transmitting electric signals.

If an electronic component is installed or added inside the DisplayPort connector or an electronic circuit (including a circuit board) is expanded inside the DisplayPort connector, the conventional DisplayPort connector has very limited internal space, such that the electronic component or electronic circuit cannot be added, or after the electronic circuit (including a circuit board) is added into the DisplayPort connector directly, the DisplayPort connector becomes larger and incompatible with the use of other mainboards.

SUMMARY OF THE INVENTION

In view of the aforementioned shortcomings, the present invention adopts the design of using the copper foil circuits on the circuit board to replace the conventional conductive pins formed by the stamping process and allowing manufacturers to add electronic components or electronic circuits by manufacturing them on the same circuit board to make the manufacture of the DisplayPort connector easier and simpler.

To achieve the foregoing objective, the present invention provides a DisplayPort structure comprising:

a base, having a containing space defined therein, a retaining wall formed at a front end of the containing space, and an opening formed on the retaining wall, and the base further including two symmetric support arms extended from the retaining walls on both side of the opening separately, two ribs formed on both sidewalls of the containing space separately, and a slideway formed between the two ribs, and the base further including a bottom tray extended from the bottom of the retaining wall, a gap formed between the retaining wall and the bottom tray, a protruding pillar disposed on a back side of the bottom tray, and an engaging portion disposed at the bottom of both sidewalls of the containing space separately;

a circuit board, installed in the containing space, and having a plurality of conductive pins made of copper foils, a transmission line segment extended from an end of the conductive pin, and a soldering hole formed at an end of the transmission line segment and provided for soldering the conductive terminal;

a chassis, having a tray portion coupled onto the base, a retaining portion bent from an end of the tray portion and coupled to a rear side of the base, a plurality of through holes formed on the tray portion and provided for passing the conductive terminals out of the through holes respectively, and a bump formed separately on both lateral sides of the tray portion and coupled to the engaging portion;

a casing, mounted onto the exterior of the base, and having a hollow main body, a port formed at a front end of the main body, a plurality of arc-shaped retaining plates coupled to the periphery of the port, a folding plate disposed at an end of the hollow main body for preventing the base from being loosened after the base is assembled into the main body and the folding plate is bent, and a group of pins extended from a lateral side of the main body and provided for electrically coupling or fixing the main body with a mainboard of an electronic device.

DESCRIPTION OF THE PREFERRED EMBODIMENTS

The technical characteristics and contents of the present invention will become apparent with the following detailed description accompanied with related drawings.

Figure 1:
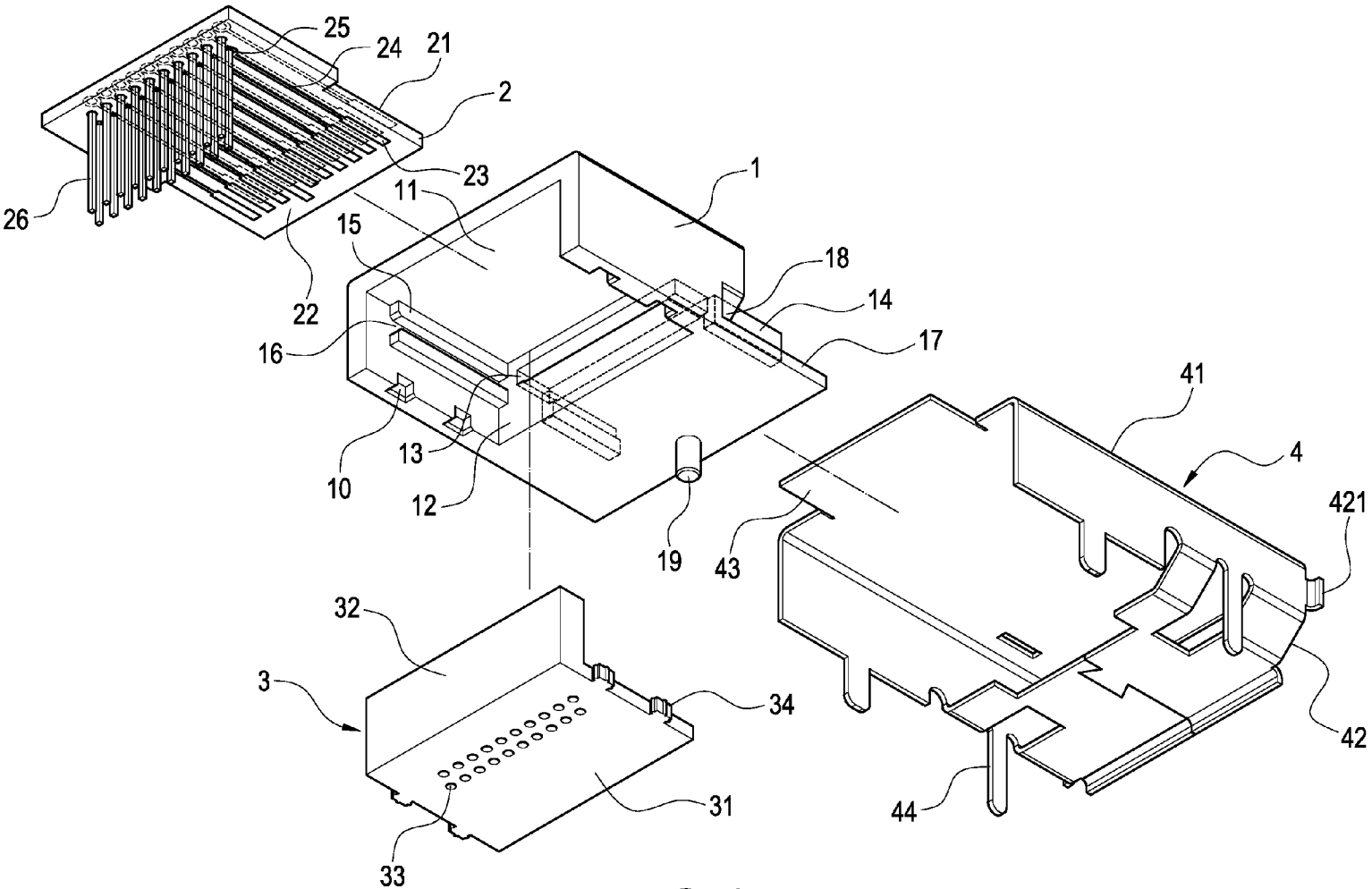
FIG. 1 is an exploded view of a DisplayPort of the present invention.
Figure 2:
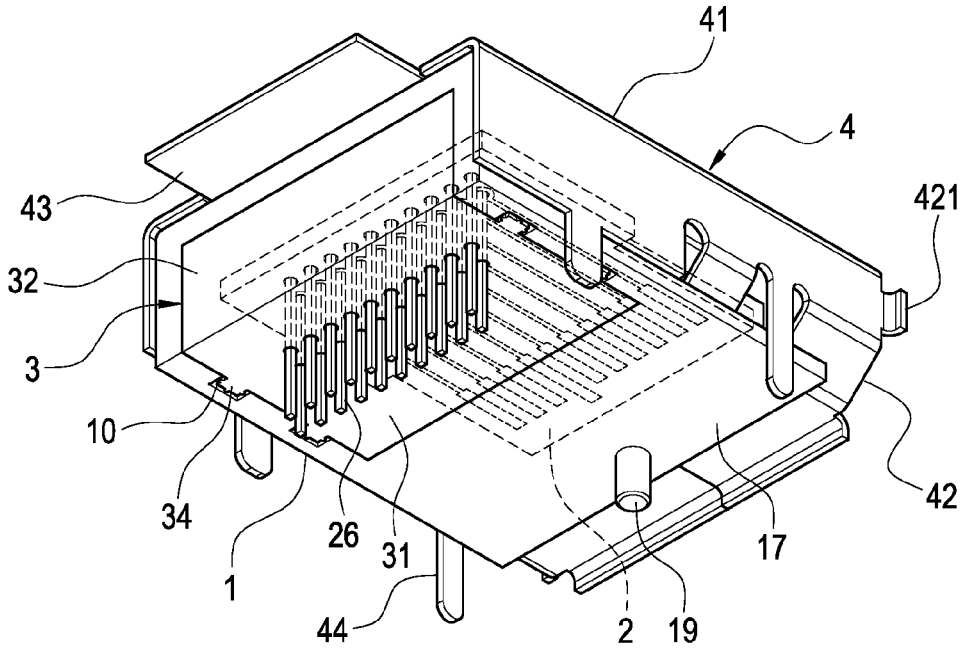
FIG. 2 is a bottom view of a DisplayPort of the present invention.
Figure 3:
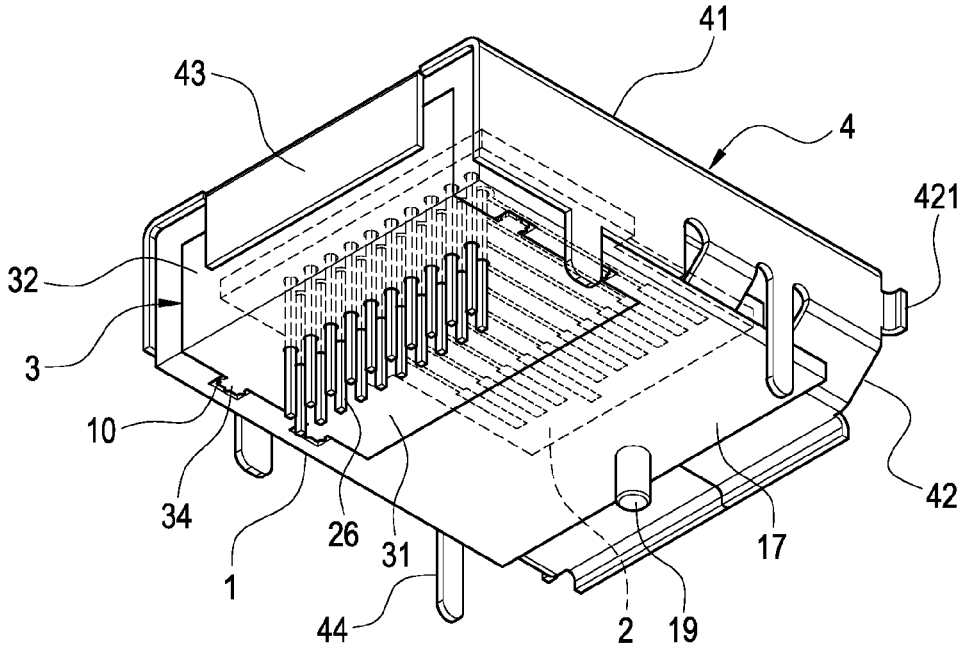
FIG. 3 is another bottom view of a DisplayPort of the present invention.

With reference to FIGS. 1 to 3 for an exploded view and bottom views of a DisplayPort structure of the present invention respectively, the DisplayPort structure comprises a base 1, a circuit board 2, a chassis 3 and a casing 4.

The base 1 is made of an insulating material and includes a containing space 11, a retaining wall 12 formed at a front end of the containing space 11, an opening 13 formed on the retaining wall 12, and two symmetric support arms 14 extended outwardly from the retaining wall 12 on both sides of the opening 13. In addition, two ribs 15 are formed on each of both sidewalls of the containing space 11, and a slideway 16 is formed between the two ribs 15 and provided for inserting the circuit board 2 and sliding the circuit board 2 out of the opening 13, and the circuit board 2 passed out of the opening 13 is supported by the two support arms 14. A bottom tray 17 is extended from the bottom of the retaining wall 12, and a gap 18 is formed between the retaining wall 12 and the bottom tray 14 and provided for inserting the bottom of the port 42 of the casing 4. A protruding pillar 19 is disposed on the back side of the bottom tray 17 and provided for fixing the connection port on a mainboard (not shown in the figure) of an electronic device. An engaging portion 10 is disposed on both sidewalls of the containing space 11 separately and provided for assembling and coupling the chassis 3.

The circuit board 2 is installed in the containing space and has a front side 21, a back side 22, and a plurality of conductive pins (or goldfingers) 23 made of copper foils and disposed between the front side 21 and the back side 22, wherein a transmission line segment 24 is extended from an end of the conductive pin 23, and a soldering hole 25 is formed at an end of the transmission line segment 24 and provided for soldering with the conductive terminal 26.

The chassis 3 is an L-shaped object made of an insulating material and includes a tray portion 31 coupled to the base 1, and a retaining portion 32 is bent from an end of the tray portion 31 and coupled to a rear side of the base 1. In addition, the tray portion 31 includes a plurality of through holes 33 for passing the conductive terminal 26 out of the through holes 33, and a bump 34 formed on both sides of the tray portion 31 separately and coupled to the engaging portion 10.

The casing 4 is made of a metal material and includes a hollow main body 41, a port 42 formed at a front end of the main body 41 and provided for inserting a plug (not shown in the figure) of a transmission line, a plurality of arc-shaped retaining plates 421 coupled to the periphery of the port 42. In addition, a folding plate 43 is disposed at an end of the hollow main body 41, and can be bent to prevent the base 1 from being loosened after the base 1 is assembled to the interior of the main body 41. A group of pins 44 is extended from a lateral side of the main body 41 and provided for electrically coupling and fixing the main body 41 to a mainboard of an electronic device (not shown in the figure).

Figure 4:
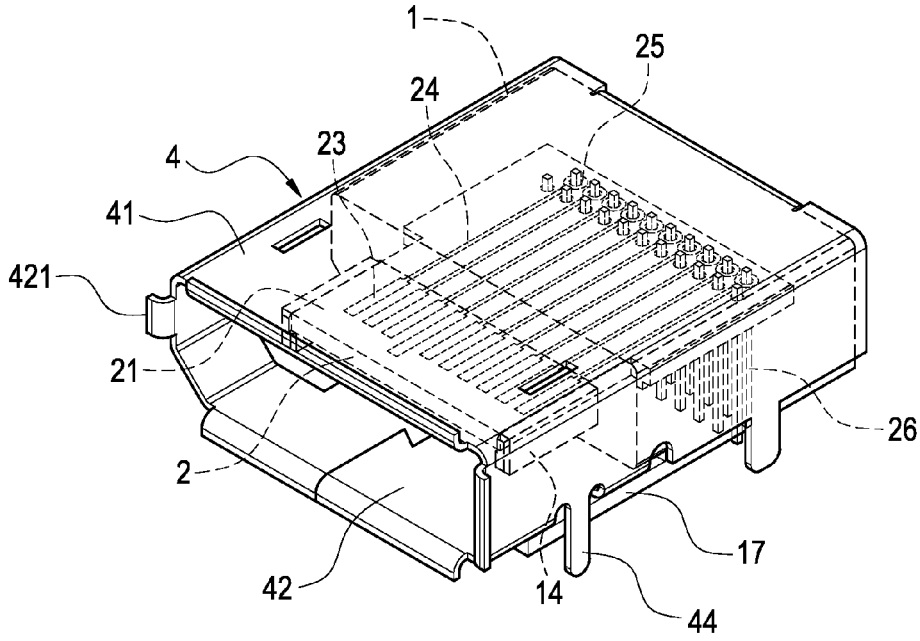
FIG. 4 is a perspective view of a DisplayPort of the present invention.
Figure 5:
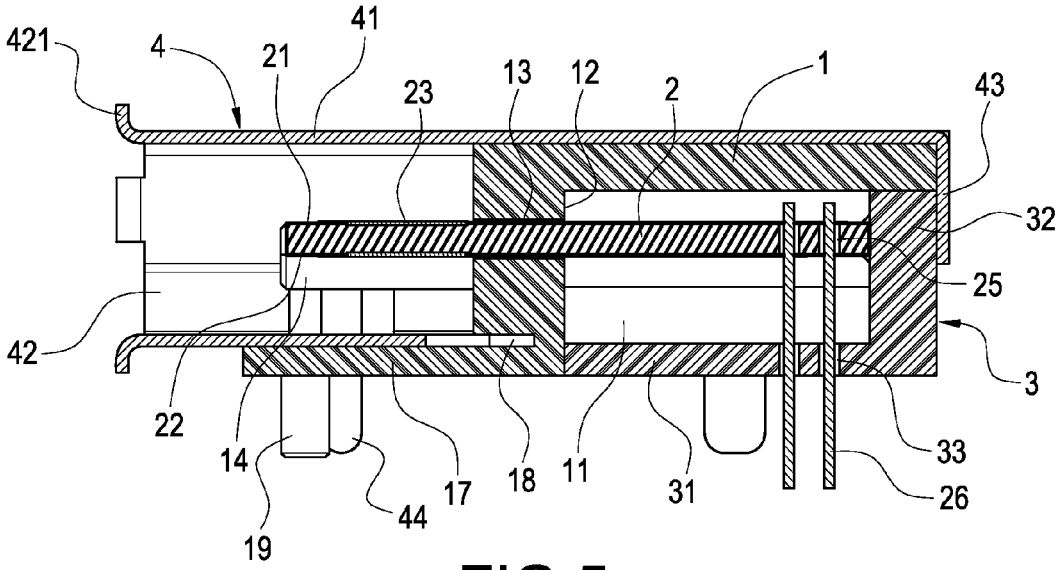
FIG. 5 is a cross-sectional view of a DisplayPort of the present invention.

With reference to FIGS. 4 and 5 for a perspective view and a cross-sectional view of a DisplayPort in accordance with the present invention, in the process of assembling the DisplayPort, the base 1 and the casing 4 are assembled first, and then the circuit board 2 is passed from the containing space 11 through the opening 13, such that the front end of the circuit board 2 is disposed on the support arms 14, or the circuit board 2 is passed from the containing space 11 through the opening 13, such that the front end of the circuit board 2 is disposed on the support arms 14.

After the base 1, the circuit board 2 and the casing 3 are assembled, the conductive terminal 26 is passed through the through hole 33 of the chassis 3, such that the chassis 3 is mounted onto the base 1, and then the folding plate 43 is bent to complete assembling the whole DisplayPort.

Figure 6:
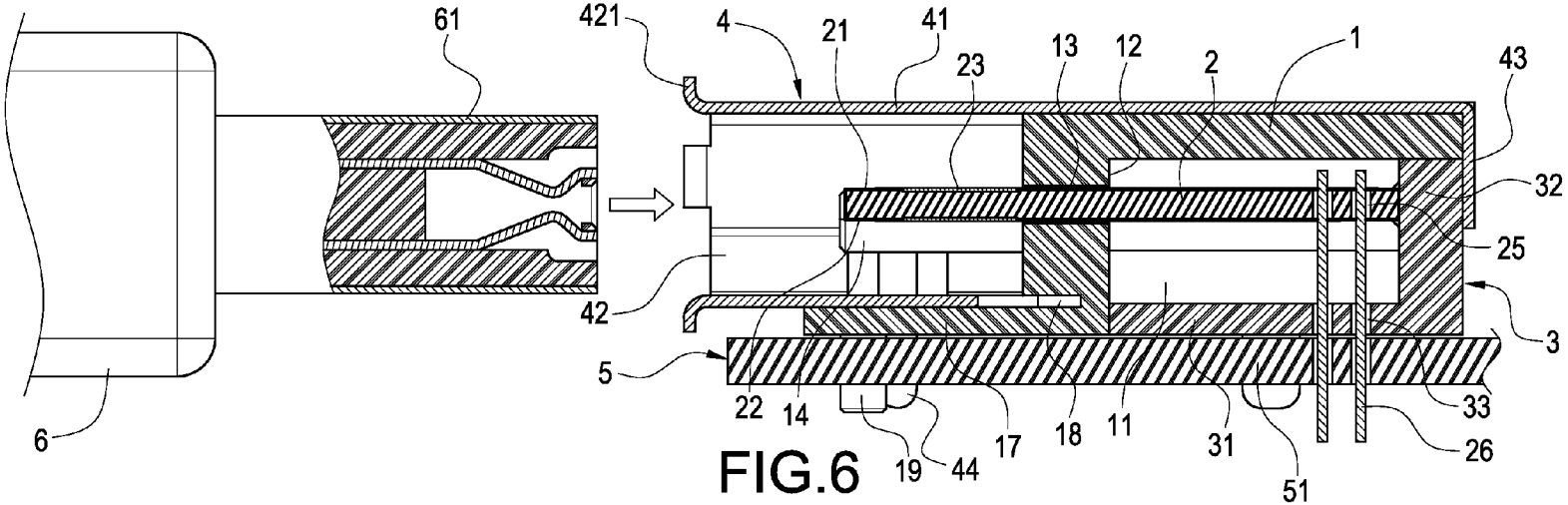
FIG. 6 is a schematic view of using a DisplayPort of the present invention.
Figure 7:
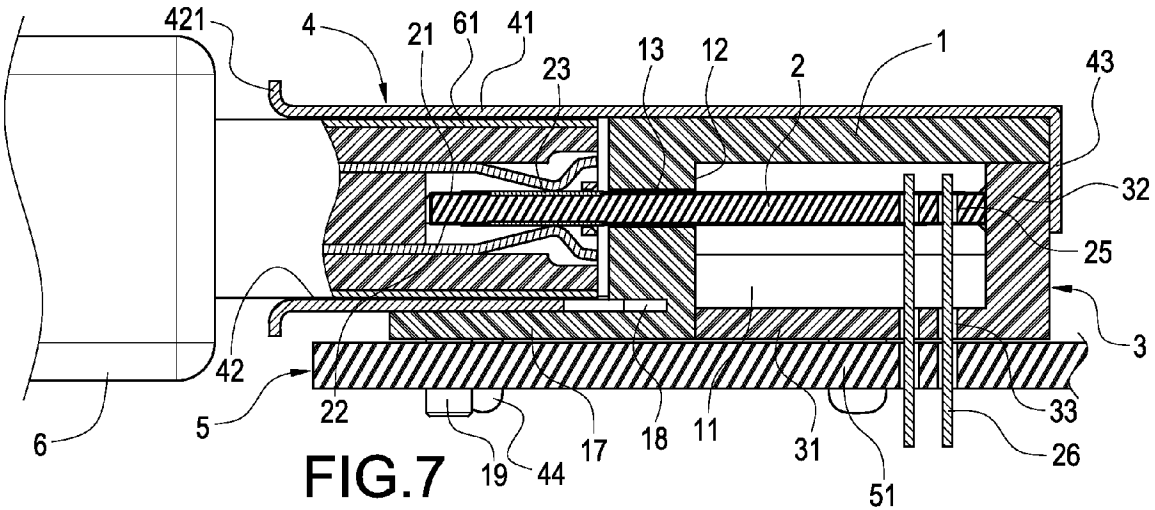
FIG. 7 is another schematic view of using a DisplayPort of the present invention.

With reference to FIGS. 6 and 7 for schematic views of using a DisplayPort of the present invention, during the use of the DisplayPort, the pins 44 of the casing 4 are passed through (for example, fixed to or electrically coupled to) the mainboard 51 of the electronic device 5, and the conductive terminal 26 is also electrically coupled to the mainboard 51.

After the DisplayPort is electrically coupled to the mainboard 51, the port 42 of the DisplayPort is provided for inserting a plug 61 of a DisplayPort transmission line 6.

Figure 8:
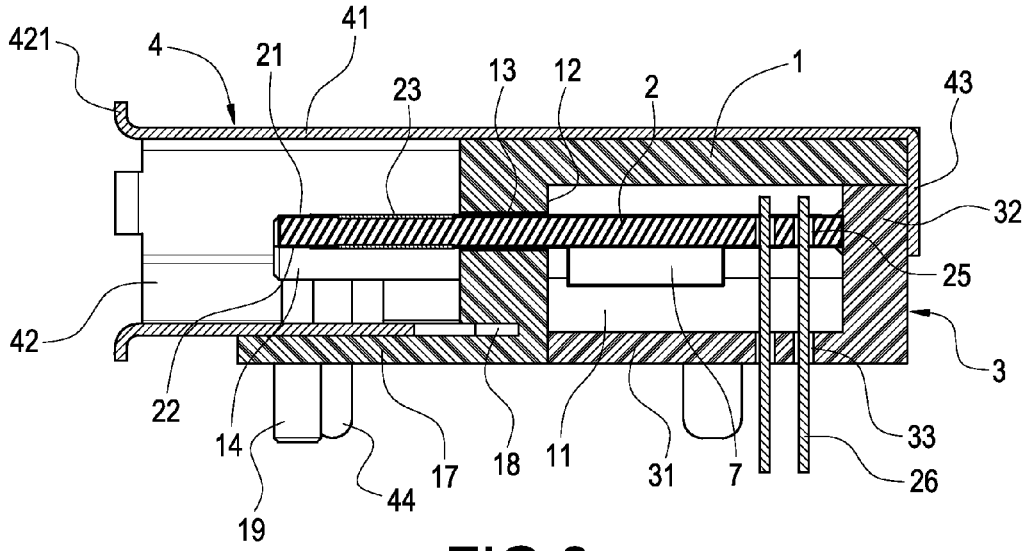
FIG. 8 is a schematic view of using a DisplayPort of a preferred embodiment of the present invention.

With reference to FIG. 8 for a schematic view of a DisplayPort in accordance with a preferred embodiment of the present invention, the present invention uses the copper foils on the circuit board 2 as the conductive pins 23 of the DisplayPort, and directly install electronic components 7 on the circuit board 2 during the production and manufacturing process, if it is necessary to add some circuits or electronic components 7 including a chip of a protection circuit, a memory, a microprocessor, or a transceiver circuit, so that the DisplayPort no longer requires an additional circuit board, and the manufacture becomes easier and simpler.

Figure 9:
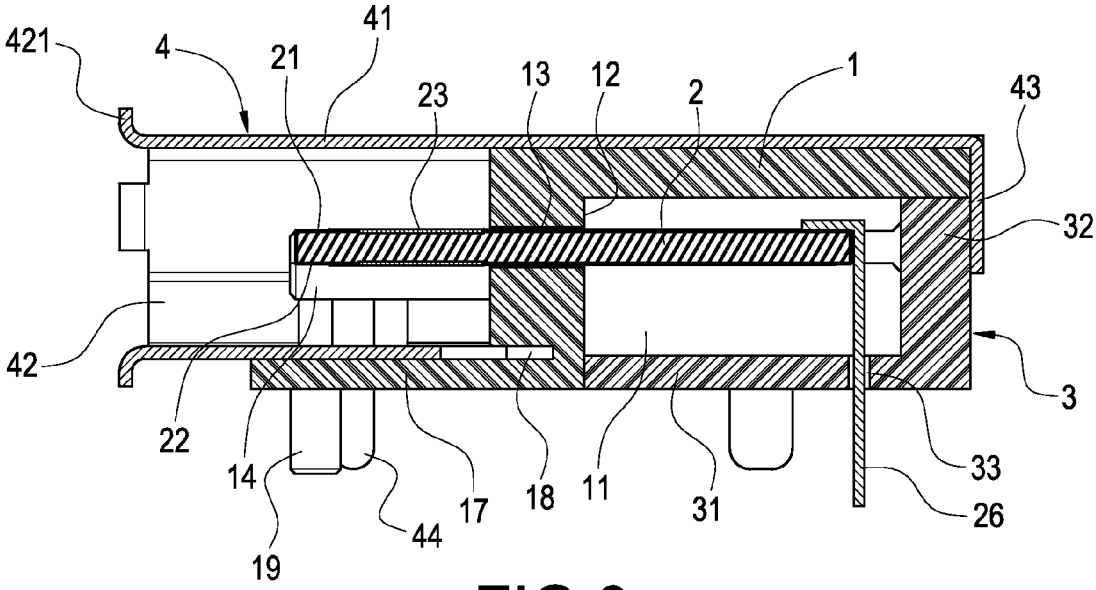
FIG. 9 is a schematic view of using a DisplayPort of another preferred embodiment of the present invention.

With reference to FIG. 9 for a schematic view of a DisplayPort in accordance with another preferred embodiment of the present invention, the soldering hole 25 is not formed on the circuit board 2, but the conductive terminals 26 are soldered together with the transmission line segment 24 to save the manufacture of the soldering hole 25.

While the invention has been described by means of specific embodiments, numerous modifications and variations could be made thereto by those skilled in the art without departing from the scope and spirit of the invention set forth in the claims.

What is claimed is:

1. A DisplayPort structure, comprising:

a base, having a containing space defined therein, a retaining wall formed at a front end of the containing space, and an opening formed on the retaining wall;

two symmetric support arms extended outwardly from the retaining walls disposed on both sides of the opening of the base respectively;

a circuit board, installed in the containing space, and an end of the circuit board passing through the opening and out of the retaining wall, and the circuit board having a front side and a back side, and at least one of the front and back sides having a plurality of conductive pins, and a transmission line segment being extended from an end of the conductive pin, and ends of the plurality of transmission line segments being respectively and electrically coupled to a plurality of conductive terminals; and a casing, mounted onto the exterior of the base, and having a hollow main body, and a port formed at a front end of the main body for exposing the circuit board, wherein the base is made of an insulating material, and wherein the retaining wall includes a bottom tray extended from the bottom of the retaining wall, and a gap is formed between the retaining wall and the bottom tray, and a protruding pillar is disposed on the back side of the bottom tray.

2. The DisplayPort structure of claim 1, further comprising two ribs formed on both sidewalls of the containing space respectively, and a slideway formed between the two ribs for inserting the circuit board and sliding the circuit board out of the opening, and the circuit board passed out of the opening being supported by the two support arms.

3. The DisplayPort structure of claim 1, further comprising an engaging portion formed at the bottom of both sidewalls of the containing space separately.

4. The DisplayPort structure of claim 3, further comprising a chassis, and the chassis being an L-shaped body made of an insulating material and having a tray portion coupled to the base, and the tray portion having a retaining portion bent from an end of the tray portion, and the retaining portion being coupled to a rear side of the base, and the tray portion further having a plurality of through holes for passing the conductive terminals out from the through holes respectively, and a bump formed on both sides of the tray portion separately and coupled to the engaging portion.

5. The DisplayPort structure of claim 1, wherein the port of the hollow main body is assembled and coupled into the gap, the port includes a plurality of arc-shaped retaining plates coupled to the periphery of the port, and a folding plate is installed at an end of the hollow main body, and a group of pins is extended from a lateral side of the main body.

6. The DisplayPort structure of claim 1, wherein the conductive pins are cupper foils disposed on the circuit board.

7. The DisplayPort structure of claim 6, wherein the conductive pins are goldfingers.

8. The DisplayPort structure of claim 6, wherein the circuit board includes an electronic component electrically coupled to the circuit board.

9. The DisplayPort structure of claim 6, wherein the circuit board includes an electronic circuit installed thereon.

10. The DisplayPort structure of claim 6, wherein the circuit board includes a plurality of soldering holes formed thereon, and the soldering holes are electrically coupled to an end of the transmission line segment and the conductive terminal.

* * * * *